US005579555A

United States Patent [19]

Pearse

[11] Patent Number: 5,579,555

[45] Date of Patent: Dec. 3, 1996

[54] SQUEEGEE ASSEMBLY FOR FLOOR CLEANING MACHINE

[75] Inventor: Stephen C. Pearse, Toledo, Ohio

[73] Assignee: The National Super Service Company, Toledo, Ohio

[21] Appl. No.: 618,076

[22] Filed: Mar. 18, 1996

Related U.S. Application Data

[63] Continuation of Ser. No. 541,827, Oct. 10, 1995, abandoned.

[51] Int. Cl.[6] ..... A47L 9/06; A47L 11/30

[52] U.S. Cl. ..... 15/320; 15/50.1; 15/98; 15/401

[58] Field of Search ..... 15/50.1, 98, 320, 15/322, 401, 245

[56] References Cited

U.S. PATENT DOCUMENTS

| | | | |
|---|---|---|---|
| 1,849,663 | 3/1932 | Finnell | 15/320 |
| 3,408,673 | 11/1968 | Oxel | 15/98 |
| 3,833,961 | 9/1974 | Fortman et al. . | |
| 3,939,518 | 2/1976 | Whitney et al. | 15/98 |
| 4,037,289 | 7/1977 | Dojan | 15/320 |
| 4,293,971 | 10/1981 | Block | 15/98 |
| 4,339,841 | 7/1982 | Waldhauser et al. | 15/359 |
| 4,429,433 | 2/1984 | Burgoon | 15/50.1 |
| 4,483,041 | 11/1984 | Waldhauser et al. | 15/359 |
| 4,619,010 | 10/1986 | Burgoon | 15/50.1 |
| 4,805,256 | 2/1989 | Mason et al. | 15/320 |
| 4,805,258 | 2/1989 | Sitarski et al. | 15/385 |
| 4,809,396 | 3/1989 | Houser | 15/320 |
| 4,817,233 | 4/1989 | Waldhauser | 15/320 |
| 4,825,500 | 5/1989 | Basham et al. | 15/319 |
| 4,854,005 | 8/1989 | Wiese et al. | 15/320 |
| 4,893,375 | 1/1990 | Girman et al. | 15/321 |
| 4,926,515 | 5/1990 | Lynn et al. | 15/4 |
| 4,937,911 | 7/1990 | Picchietti, Sr. et al. | 15/320 |
| 4,942,638 | 7/1990 | Helm | 15/50.1 |
| 5,088,151 | 2/1992 | Legatt | 15/385 |
| 5,155,876 | 10/1992 | Whitaker | 15/320 |
| 5,165,134 | 11/1992 | Moore | 15/98 |
| 5,239,720 | 8/1993 | Wood et al. | 15/4 |
| 5,265,300 | 11/1993 | O'Hara et al. | 15/49.1 |
| 5,319,828 | 6/1994 | Waldhauser et al. | 15/320 |
| 5,369,838 | 12/1994 | Wood et al. | 15/320 |
| 5,377,382 | 1/1995 | Bores et al. | 15/340.1 |
| 5,383,251 | 1/1995 | Whitaker et al. | 15/320 |

*Primary Examiner*—Mark Spisich
*Attorney, Agent, or Firm*—MacMillan, Sobanski & Todd

[57] ABSTRACT

A squeegee assembly for use in a floor cleaning machine includes a housing which includes a forward plate and a rearward plate. The opposed ends of the forward plate and the rearward plate converge toward one another to form an interior wedge. One or more squeegee blades are disposed within the housing of the squeegee assembly adjacent to the forward and rearward plates thereof. A pair of wedge bars are provided within the housing of the squeegee assembly for releasably securing the squeegee blades thereto. The wedge bars are preferably identical, each having an outer shape which corresponds to the shape of the interior wedge defined by the forward and rearward plates. A wedge member is provided for moving the wedge bars between an engaged position, wherein the squeegee blades are frictionally engaged between the wedge bars and the forward and rearward plates, and a disengaged position, wherein the squeegee blades are not frictionally engaged between the wedge bars and the forward and rearward plates. The wedge member is formed generally in the shape of a trapezoid, having a relatively short upper surface and a relatively long lower surface which are connected together by a pair of oppositely angled side surfaces. To secure the squeegee blades to the housing, bolts are tightened which draw the wedge member upwardly toward the top plate of the housing. As this occurs, the angled side surfaces of the wedge member engage downwardly facing tapered surfaces formed on the inner ends of the wedge bars, causing the wedge bars to move outwardly apart from one another. When so moved, the wedge bars are moved toward the forward and rearward plates so as to frictionally engage the squeegee blades therebetween.

20 Claims, 4 Drawing Sheets

SQUEEGEE ASSEMBLY FOR FLOOR CLEANING MACHINE

This application is a continuation of application Ser. No. 08/541,827, filed Oct. 10, 1995, now abandoned.

BACKGROUND OF THE INVENTION

This invention relates in general to floor cleaning machines and in particular to an improved structure for releasably supporting one or more squeegee blades on a squeegee assembly carded by such a floor cleaning machine.

Floor cleaning machines are well known structures which are commonly used in commercial and industrial facilities to clean relatively large floor surfaces. A typical floor cleaning machine includes a chassis which carries a floor cleaning mechanism thereon. A plurality of wheels are provided on the chassis to facilitate movement of the floor cleaning mechanism along the floor. In some instances, a drive mechanism is provided on the chassis to assist the operator in moving the floor cleaning machine during use. A number of different floor cleaning mechanisms are known in the art.

Some of these floor cleaning mechanisms are adapted for use on soft surfaces, such as carpet, while other floor cleaning mechanisms are adapted for use on hard surfaces, such as tile. In either event, many floor cleaning mechanisms include some means for applying a liquid substance to the floor surface. As the floor cleaning mechanism passes over the floor, the liquid is applied thereto. Because it would be undesirable to leave the floor in a wet condition, the floor cleaning machine typically includes a vacuum structure mounted at the rear thereof for removing substantially all of the liquid from the floor.

In those floor cleaning machines which are adapted for use on hard surfaces, the vacuum structure typically includes a squeegee assembly. A typical squeegee assembly includes a housing which carries a flexible squeegee blade thereon. The squeegee housing and blade extend across the entire width of the rear of the floor cleaning machine. The squeegee blade extends downwardly from the housing and resiliently engages the floor, sliding along the floor as the floor cleaning machine is moved during use. The squeegee blade functions to gather virtually all of the liquid on the floor within the housing. The vacuum structure sucks the gathered liquid up from the squeegee assembly and stores it within the floor cleaning machine for later disposal. A number of squeegee assemblies of this general type are known in the art.

Because of its constant sliding engagement with the floor during use and because of the relative softness of the flexible material used to form it, the squeegee blade must be periodically replaced to insure good performance. Unfortunately, it has been found to be relatively time consuming and difficult to change squeegee blades in known squeegee assemblies. Also, it has been found that known squeegee assemblies contain a relatively large number of parts, which increases expense. Accordingly, it would desirable to provide an improved structure for a squeegee assembly which is simple and inexpensive in structure and operation, and further allows the squeegee blade to be replaced in a relatively simple manner.

SUMMARY OF THE INVENTION

This invention relates to an improved structure for a squeegee assembly used in a floor cleaning machine. The squeegee assembly includes a housing which includes a top plate, a forward plate, and a rearward plate which are connected together to define a generally inverted-U shaped enclosed space. The opposed ends of the forward plate and the rearward plate converge toward one another to form an interior wedge. One or more squeegee blades are disposed within the housing of the squeegee assembly adjacent to the forward and rearward plates thereof. A pair of wedge bars are provided within the housing of the squeegee assembly for releasably securing the squeegee blades thereto. The wedge bars are preferably identical, each having an outer shape which corresponds to the shape of the interior wedge defined by the forward and rearward plates. A wedge member is provided for moving the wedge bars between an engaged position, wherein the squeegee blades are frictionally engaged between the wedge bars and the forward and rearward plates, and a disengaged position, wherein the squeegee blades are not frictionally engaged between the wedge bars and the forward and rearward plates. The wedge member is formed generally in the shape of a trapezoid, having a relatively short upper surface and a relatively long lower surface which are connected together by a pair of oppositely angled side surfaces. To secure the squeegee blades to the housing, bolts are tightened which draw the wedge member upwardly toward the top plate of the housing. As this occurs, the angled side surfaces of the wedge member engage downwardly facing tapered surfaces formed on the inner ends of the wedge bars, causing the wedge bars to move outwardly apart from one another. When so moved, the wedge bars are moved toward the forward and rearward plates so as to frictionally engage the squeegee blades therebetween.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
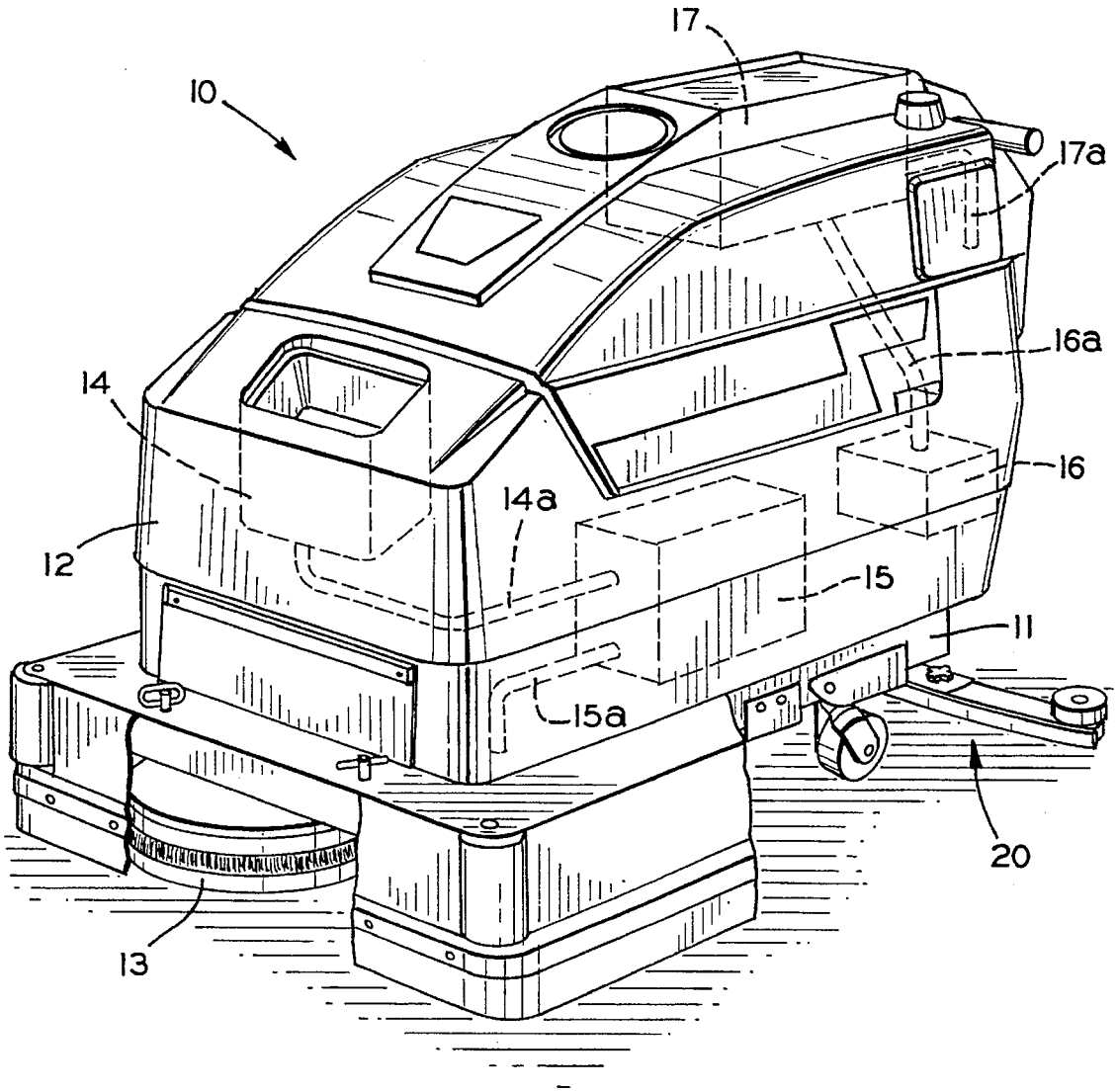
FIG. 1 is a front perspective view of a floor cleaning machine including a squeegee assembly in accordance with this invention.

Referring now to the drawings, there is illustrated in FIG. 1 a floor cleaning machine, indicated generally at 10, in accordance with this invention. The floor cleaning machine 10 is generally conventional in the art, and only those portions of the floor cleaning machine 10 which are necessary for a complete understanding of this invention will be described and illustrated. The illustrated floor cleaning machine 10 is a floor scrubbing machine, although it will be apparent to those skilled in the art that this invention may be used with many other types of floor cleaning machines. The illustrated floor cleaning machine 10 includes a chassis 11 having an outer housing 12 supported thereon. The rear end of the chassis 11 of the floor cleaning machine 10 includes a mounting bracket 11*a* having a pair of spaced apart forks 11*b* (see FIG. 2) for a purpose which will be explained in detail below.

The floor cleaning machine 10 carries a number of components thereof for cleaning the floor. In the illustrated embodiment, a pair of rotatably driven brushes 13 (only one is illustrated) are carded on the forward end of the chassis 11. The floor cleaning machine 10 also includes a fluid reservoir 14 for storing a quantity of a liquid cleaning substance therein. Liquid from the reservoir is drawn through an inlet hose 14*a* by a liquid pump 15 and sprayed through an outlet hose 15*a* on the floor adjacent to the brushes 13. The brushes 13 scrub the liquid onto the floor to remove dirt therefrom. To collect the dirty liquid from the floor, a vacuum pump 16 is provided on the chassis 11. The vacuum pump is connected through a hose 16*a* to a recovery tank 17 which is also carried on the chassis 11. The recovery tank 17 is, in turn, connected through a hose 17*a* to a squeegee assembly, indicated generally at 20. The structure and operation of the squeegee assembly 20 will be described in detail below. Briefly, however, when the vacuum pump 16 is operated, liquid on the floor is sucked up through the squeegee assembly 20 through the hose 17*a* for collection in the recovery tank 17. The structure of the floor cleaning machine 10 thus far described is conventional in the art.

Figure 2:
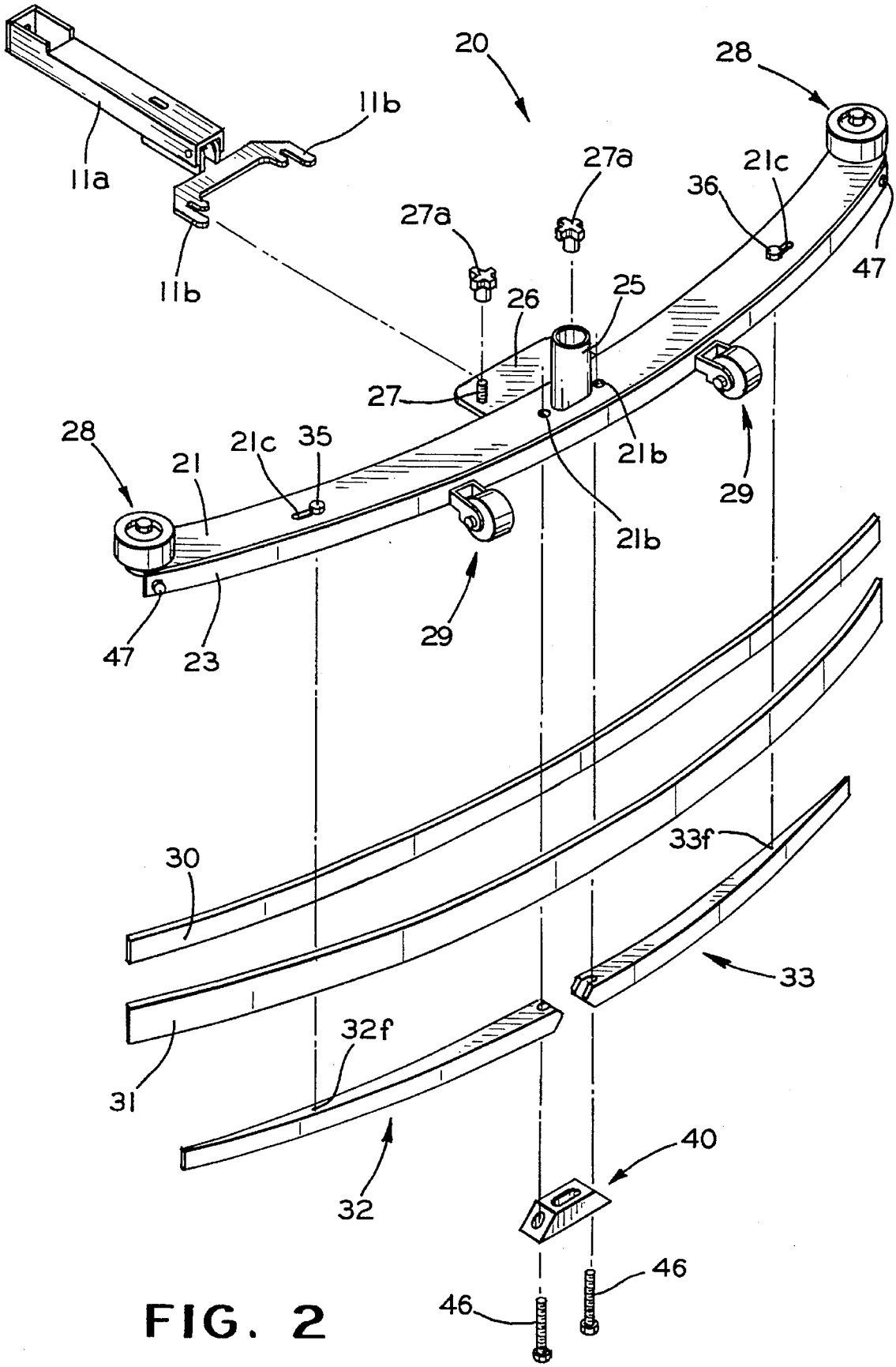
FIG. 2 is an exploded rear perspective view of the chassis mounting bracket and squeegee assembly of the floor cleaning machine illustrated in FIG. 1.

Referring now to FIG. 2, the structure of the squeegee assembly 20 is illustrated in detail. As shown therein, the squeegee assembly 20 includes a housing which is formed from a top plate 21, a forward plate 22 (see FIGS. 4 and 6), and a rearward plate 23. The three plates 21, 22, and 23 of the housing are preferably formed from a strong rigid material, such as steel. The forward plate 22 and the rearward plate 23 are vertically oriented and can be secured to the horizontal top plate 21 by any conventional means, such as by welding. As a result, the housing of the squeegee assembly 20 has a generally inverted-U cross sectional shape and defines an enclosed space which faces downwardly toward the floor.

The illustrated housing for the squeegee assembly 20 is gently arcuate in shape. To accomplish this, the forward plate 22 and the rearward plate 23 are formed to extend along respective radii of curvature. In the illustrated embodiment, the radius of curvature of the forward plate 22 is somewhat larger than the radius of curvature of the rearward plate 23. As a result, the spacing between the forward plate 22 and the rearward plate 23 is at a maximum at the center of the squeegee assembly 20 and a minimum at the opposed ends of the squeegee assembly 20. Thus, the opposed ends of the forward plate 22 and the rearward plate 23 converge toward one another to form an interior wedge. The purpose for this converging structure will be explained below.

A relatively large central opening 21*a*(see FIGS. 3 and 5) is formed through the top plate 21 of the housing of the squeegee assembly 20. A pair of side openings 21*b*(see FIGS. 3 and 5) are formed through the top plate 21 of the housing adjacent to the center thereof. The side openings 21*b* are located on opposite sides of the central opening 21*a*. A bushing 24 is press fit within each of the side openings 21*b*. Each of the bushings 24 is hollow and cylindrical in shape, having an inner surface which is threaded. A pair of slots 21*c* are formed through the upper surface of the top plate 21 near the ends thereof. The purposes of the central opening 21*a*, the side openings 21*b* having the threaded bushings 24 therein, and the slots 21*c* will be described below.

Figure 3:
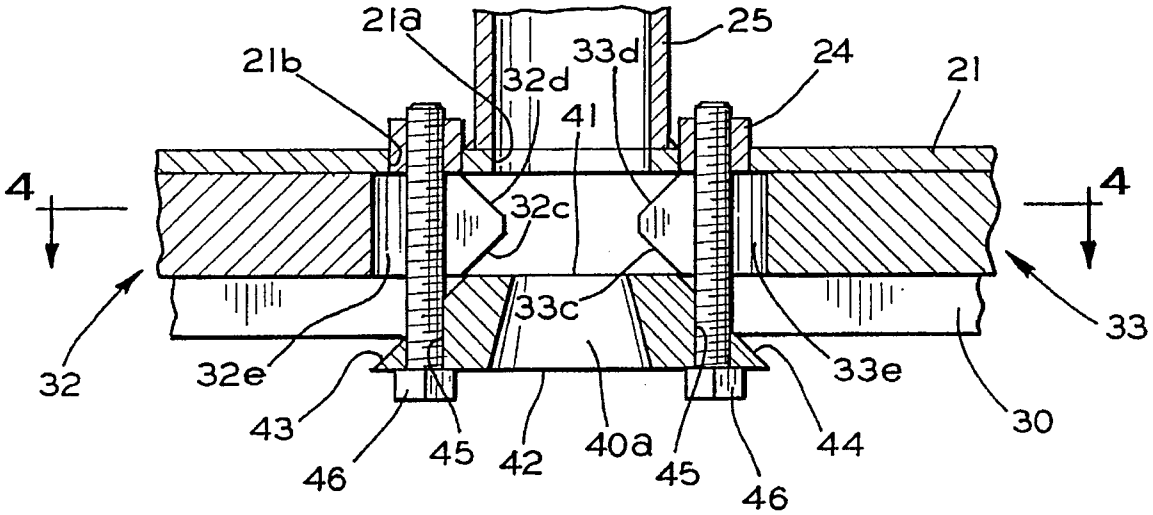
FIG. 3 is an enlarged rear end sectional elevational view of the central portion of the squeegee assembly illustrated in FIGS. 1 and 2 shown in a disengaged position, wherein the squeegee blades may be inserted and removed.
Figure 5:
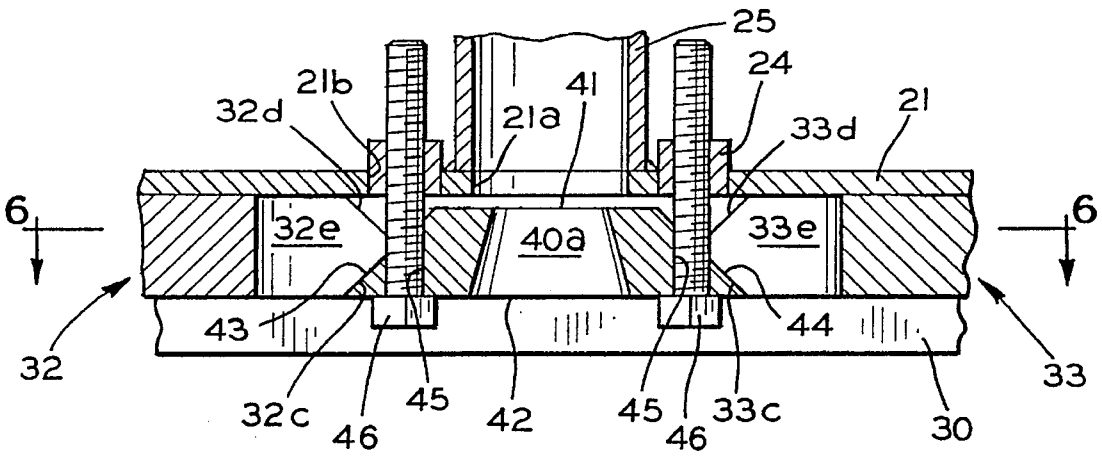
FIG. 5 is a rear end sectional elevational view of the central portion of the squeegee assembly similar to FIG. 3 shown in an engaged position, wherein the squeegee blades are frictionally engaged for use.

An upstanding vacuum hose mount 25 is secured about the central opening 21*a* formed through the top plate 21 of the squeegee assembly 20. The vacuum hose mount 25 is preferably hollow and cylindrical in shape and extends vertically upwardly from the top plate 21. The vacuum hose mount 25 is preferably formed from the same material as the plates 21, 22, and 23 of the housing and is secured thereto in the same manner. The vacuum hose mount 25 is provided to facilitate the connection of the vacuum hose 17*a* to the squeegee assembly 20. As best shown in FIGS. 3 and 5, the vacuum hose mount 25 and the vacuum hose 17*a* provide for fluid communication between the enclosed space defined by the housing of the squeegee assembly 20 and the recovery tank 17 contained within the floor cleaning machine 10. A horizontally oriented mounting plate 26 is secured to the central portion of the housing of the squeegee assembly 20 and extends forwardly therefrom. The mounting plate 26 is also preferably formed from the same material as the plates 21, 22, and 23 of the housing and can be secured thereto in the same manner. A pair of upwardly extending threaded studs 27 (only one is illustrated) are secured to the mounting plate 26. The studs 27 are provided for releasably securing the squeegee assembly 20 to the chassis 11 of the floor cleaning machine 10, in a manner which will be explained in detail below.

A pair of side roller assemblies, indicated generally at 28, are mounted on the opposed ends of the top plate 21 of the housing of the squeegee assembly 20. The side roller assemblies 28 are conventional in the art and are provided to prevent the ends of the housing of the squeegee assembly 20 from scraping along a lower portion of a wall when the floor cleaning machine 10 is used to clean a portion of a floor near such a wall. A pair of floor roller assemblies, indicated generally at 29, are mounted on the rearward plate 23 of the housing of the squeegee assembly 20. The floor roller assemblies 29 are also conventional in the art and are provided to prevent the rigid housing of the squeegee assembly 20 from dragging along the floor when the floor cleaning machine 10 is used.

The squeegee assembly 20 further includes a forward squeegee blade 30 and a rearward squeegee blade 31. The squeegee blades 30 and 31 are preferably formed from elongated strips of a flexible, water resistant material, such as gum rubber. However, the squeegee blades 30 and 31 can be formed from any conventional material. The forward squeegee blade 30 is disposed within the enclosed space defined by the housing of the squeegee assembly 20 adjacent to the forward plate 22 thereof. Similarly, the rearward squeegee blade 31 is disposed within the enclosed space defined by the housing of the squeegee assembly 20 adjacent to the rearward plate 23 of the housing of the squeegee assembly 20.

A pair of wedge bars, indicated generally at 32 and 33, are provided for releasably securing the squeegee blades 30 and 31 to the housing of the squeegee assembly 20. The wedge bars 32 and 33 are preferably identical in shape, each being elongated and gently curved in shape. Each of the wedge bars 32 and 33 has a forwardly facing surface 32*a* and 33*a*, respectively, which has approximately the same radius of curvature as the forward plate 22 of the housing of the squeegee assembly 20. Similarly, each of the wedge bars 32 and 33 has a rearwardly facing surface 32*b* and 33*b*, respectively, which has approximately the same radius of curvature as the rearward plate 23 of the housing of the squeegee assembly 20. Thus, the outer ends of the wedge bars 32 and 33 taper to a point which is similar in shape to the shape of the interior wedges defined by the opposed ends of the forward plate 22 and the rearward plate 23.

Figure 4:
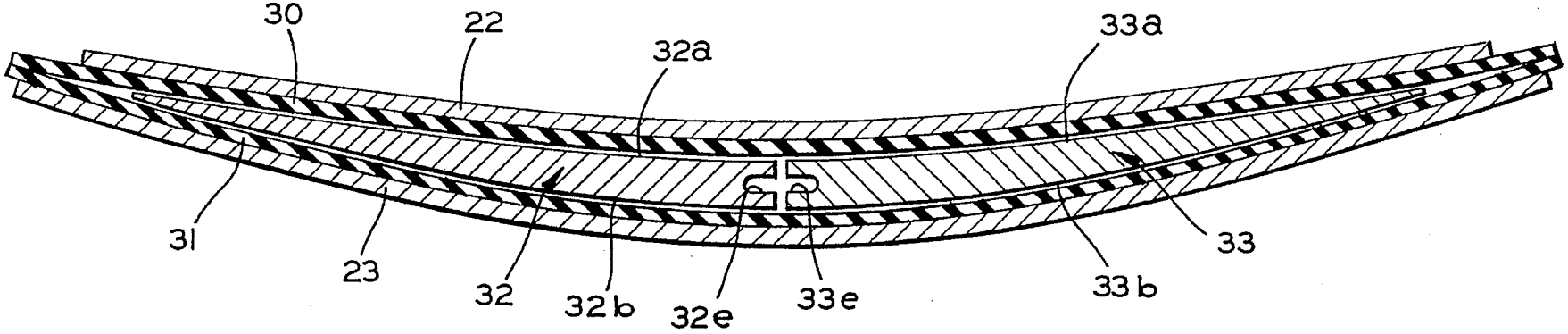
FIG. 4 is an enlarged sectional elevational view of the squeegee assembly taken along line 4—4 of FIG. 3, wherein the wedge block and bolts have been omitted for clarity.
Figure 6:
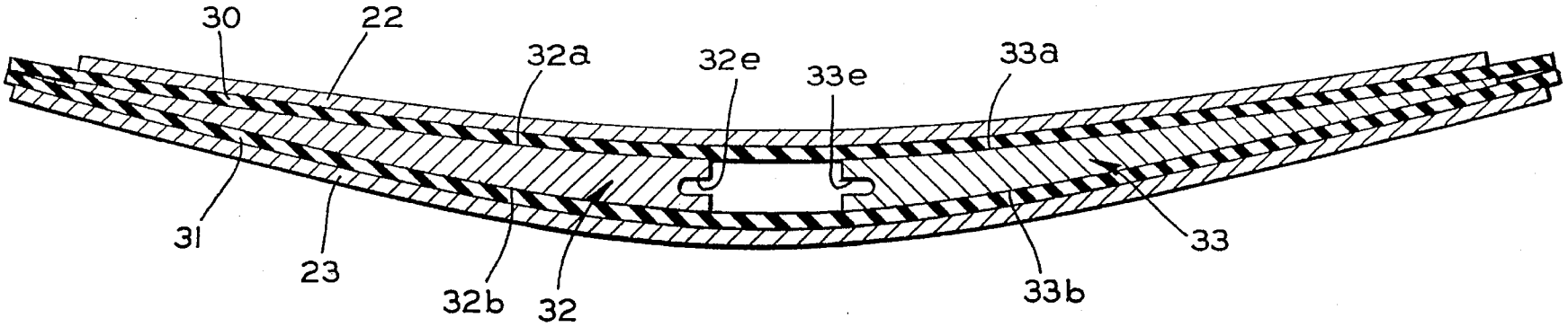
FIG. 6 is an enlarged sectional elevational view of the squeegee assembly taken along line 6—6 of FIG. 5, wherein the wedge block and bolts have been omitted for clarity.

The inner ends of the wedge bars 32 and 33 terminate in respective downwardly facing tapered surfaces. As best shown in FIGS. 3 and 5, the inner end of the wedge bar 32 terminates in a downwardly facing tapered surface 32*c*, while the inner end of the wedge bar 33 terminates in a downwardly facing tapered surface 33*c*. The downwardly facing tapered surfaces 32*c* and 33*c* extend approximately half of the vertical thickness of the respective wedge bars 32 and 33, and are mirrored by respective upwardly facing tapered surfaces 32*d* and 33*d*. Thus, in the preferred embodiment, the wedge bar 32 is identical in structure to the wedge bar 33, and the two wedge bars 32 and 33 are oriented in a mirror-image manner on the squeegee assembly 20. Additionally, the inner ends of the two wedge bars 32 and 33 have respective vertically extending slots 32*e* formed therein, as best shown in FIGS. 2, 4, and 6. As will be explained in further detail below, the wedge bars 32 and 33 are disposed within the housing of the squeegee assembly 20 between the forward squeegee blade 30 and the rearward squeegee blade 31.

Referring back to FIG. 2, it can be seen that threaded openings 32*f* and 33*f* are respectively formed in the upper surfaces of the wedge bars 32 and 33. Respective threaded fasteners 35 and 36 extend through the slots 21*c* formed through the top plate 21 of the housing of the squeegee assembly 20 to support the wedge bars 32 and 33 thereon. Because the slots 21*c* extend laterally somewhat along the respective sides of the top plate 21, it will be appreciated that the threaded fasteners 35 and 36 can be loosened somewhat to support the wedge bars 32 and 33 thereon, while permitting a limited amount of sliding movement relative to the housing of the squeegee assembly 20. The purpose for this sliding support structure will become apparent below.

The squeegee assembly 20 further includes a wedge member, indicated generally at 40 engaged with the wedge bars 32 and 33. The wedge member 40 is provided for moving the wedge bars 32 and 33 between an engaged position, wherein the squeegee blades 30 and 31 are frictionally engaged between the wedge bars 32 and 33 and the forward and rearward plates 22 and 23 of the housing of the squeegee assembly 20, and a disengaged position, wherein the squeegee blades 30 and 31 are not frictionally engaged between the wedge bars 32 and 33 and the forward and rearward plates 22 and 23 of the housing of the squeegee assembly 20. To accomplish this, the wedge member 40 is formed generally in the shape of a trapezoid, having an upper surface 41 and a lower surface 42 which are connected together by a pair of oppositely angled side surfaces 43 and 44. The upper surface 41 is shorter in length than the lower surface 42. Thus, the angled side surfaces 43 and 44 face upwardly, as best shown in FIGS. 3 and 5. A central opening 40*a* is formed through the wedge member 40 for a purpose which will be explained below.

A pair of vertical openings 45 are formed through the wedge member 40. The openings 45 extend upwardly from the lower surface 42 and respectively through the angled side surfaces 43 and 44. An inverted bolt 46 extends through each of the openings 45. Each of the bolts 46 includes a threaded shank portion which extends upwardly through the openings 45 formed through the wedge member 40, through the slots 32*e* and 33*e* respectively formed in the ends of the wedge bars 32 and 33, and into threaded engagement with the threaded bushings 24 secured to the top plate 21 of the housing of the squeegee assembly 20. In this manner, the wedge member 40 is secured to the housing of the squeegee assembly 20.

As mentioned above, a pair of upwardly extending threaded studs 27 are secured to the mounting plate 26 for releasably securing the squeegee assembly 20 to the chassis 11 of the floor cleaning machine 10. Referring back to FIG. 2, the mounting bracket 11*a* and spaced apart forks 11*b* are illustrated in detail. To install the squeegee assembly 20 on the chassis 11, the mounting plate 26 is moved beneath the mounting bracket 11*a* such that the threaded studs 27 extend upwardly through the forks 11*b*. Then, enlarged cap nuts 27*a* are threaded onto the threaded studs 27 and tightened down against the forks 11*b*. In this manner, the squeegee assembly 20 is releasably secured to the mounting plate 11*a*. The mounting plate 11*a* may, if desired, be supported on the chassis 11 for limited vertical movement in a manner which is well known in the art.

During use, the liquid pump 15 is energized to supply liquid to the brushes 13 of the floor cleaning machine 10. The brushes 13 scrub the liquid onto the floor to remove dirt therefrom. To collect the dirty liquid from the floor, the vacuum pump 16 is energized to suck the liquid up through the central opening 40*a* of the wedge member 40, the central opening 21*a* of the top plate 21, and through the hose 17*a* to the recovery tank 17 for later disposal. As all of this is occurring, the floor cleaning machine 10 can be moved continuously along a floor.

Prior to operating the floor cleaning machine 10 in this manner, however, it is necessary to install the squeegee blades 30 and 31 on the squeegee assembly 20. To accomplish this, the components of the squeegee assembly 20 are initially oriented in the disengaged position illustrated in FIGS. 3 and 4. In this disengaged position, the bolts 46 are loosened such that the wedge member 40 can be moved downwardly away from the top plate 21 of the housing of the squeegee assembly 20. As a result, the wedge bars 32 and 33 can be moved inwardly toward one another. Such sliding movement of the wedge bars 32 and 33 can be accomplished easily because they are supported on the top plate 21 of the housing of the squeegee assembly 20 by the threaded fasteners 35. As discussed above, the threaded fasteners 35 extend through the slots 21*c* formed through the top plate 21 of the housing of the squeegee assembly 20 to slidably support the wedge bars 32 and 33 thereon when loosened. When moved inwardly toward one another, the forwardly facing surfaces 32*a* and 33*a* and the rearwardly facing surfaces 32*b* and 33*b* of the wedge bars 32 and 33, respectively, are moved away from the associated forward plate 22 and rearward plate 23 of the housing of the squeegee assembly 20. Consequently, the squeegee blades 30 and 31 are not frictionally engaged between the wedge bars 32 and 33 and the forward and rearward plates 22 and 23 of the housing of the squeegee assembly 20. In this position, the squeegee blades 30 and 31 can be removed and installed.

To secure the squeegee blades 30 and 31 to the housing of the squeegee assembly 20, the bolts 46 are tightened such that the wedge member 40 is drawn upwardly toward the top plate 21 of the housing of the squeegee assembly 20. As this occurs, the angled side surfaces 43 and 44 of the wedge member 40 engage the downwardly facing tapered surfaces 32*c* and 33*c* formed on the inner ends of the wedge bars 32 and 33, respectively. Consequently, the wedge bars 32 and 33 are moved outwardly apart from one another. When moved outwardly apart from one another, the forwardly facing surfaces 32*a* and 33*a* and the rearwardly facing surfaces 32*b* and 33*b* of the wedge bars 32 and 33, respectively, are moved toward the associated forward plate 22 and rearward plate 23 of the housing of the squeegee assembly 20. Consequently, the squeegee blades 30 and 31 are frictionally engaged between the wedge bars 32 and 33 and the forward and rearward plates 22 and 23 of the housing of the squeegee assembly 20.

The wedge bars 32 and 33 do not necessarily extend the entire length of the squeegee blades 30 and 31. In the illustrated embodiment, the outermost ends of the squeegee blades 30 and 31 are not frictionally engaged between the wedge bars 32 and 33 and the forward and rearward plates 22 and 23 of the housing of the squeegee assembly 20. In this instance, it may be desirable to provide a supplemental structure for retaining the outermost ends of the squeegee blades 30 and 31 on the housing of the squeegee assembly 20. To accomplish this, a pair of threaded fasteners 47 are provided which extend through respective openings formed through the forward plate 22, the squeegee blades 30 and 31, and the rearward plate 23 at the outermost ends thereof. The threaded fasteners 47 can be secured to the housing of the squeegee assembly 20 by conventional nuts (now shown).

As discussed above, the forward plate 22 and the rearward plate 23 are both curved in the illustrated embodiment, with the radius of curvature of the forward plate 22 being somewhat larger than the radius of curvature of the rearward plate 23. However, the forward plate 22 and the rearward plate 23 may be shaped other than as specifically shown and still provide the converging interior wedge structure. For example, the radius of curvature of the forward plate 22 can be somewhat smaller than the radius of curvature of the rearward plate 23. Alternatively, the ends of the forward plate 22 may extend linearly, while the ends of the rearward plate 23 are curved gently toward the ends of the forward plate 22 (or vice versa). Similarly, the ends of the forward plate 22 and the rearward plate 23 may both be linear in shape, converging toward one another to form an interior wedge having the general shape of a triangle.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A squeegee assembly comprising:

first and second plates having ends, said first and second plates positioned so that said ends of said first and second plates generally converge;

a squeegee blade positioned between said first and second plates;

a wedge bar positioned between said squeegee blade and said second plate, said wedge bar having an end with an angled surface and first and second converging surfaces; and a wedge member having an angled surface which is positioned adjacent to said angled surface of said wedge bar, wherein movement of said wedge member in a first direction causes said wedge bar to move because of the cooperating angled surfaces of said wedge bar and said wedge member in a second direction, the movement of said wedge bar in said second direction causing said first surface of said wedge bar to move toward said squeegee blade, and said second surface of said wedge bar to move toward said second plate, thereby securing said squeegee blade to the squeegee assembly.

2. The squeegee assembly defined in claim 1 wherein said second direction is generally normal to said first direction.

3. The squeegee assembly defined in claim 1 wherein said first and second converging surfaces of said wedge bar converge at approximately the same convergence as said first and second plates.

4. The squeegee assembly defined in claim 1 wherein said angled surface of said wedge bar is a tapered surface.

5. The squeegee assembly defined in claim 1 wherein said wedge bar is supported for sliding movement relative to said first and second plates.

6. The squeegee assembly defined in claim 1 wherein a pair of wedge bars is positioned between said squeegee blade and said second plate, each of said wedge bars having an end with an angled surface and first and second converging surfaces, and wherein said wedge member has a pair of angled surfaces positioned adjacent to said angled surfaces of said wedge bars, wherein movement of said wedge member in a first direction causes each of said wedge bars to move in a second direction, because of the cooperating angled surfaces of each of said wedge bars and the angled surfaces of said wedge member, the movement of each of said wedge bars in said second direction causing said first surface of each of said wedge bars to move toward said squeegee blade, and said second surface of each of said wedge bars to move toward said second plate, thereby securing said squeegee blade to the squeegee assembly.

7. The squeegee assembly defined in claim 6 wherein said wedge bars are substantially identical in shape.

8. The squeegee assembly defined in claim 6 wherein said wedge member moves generally upward and said wedge bars move generally outward and apart from one another.

9. The squeegee assembly defined in claim 1 wherein said ends of said first and second plates generally converge because each of said first and second plates is generally arcuate in shape, and the radius of curvature of said first plate is larger than the radius of curvature of said second plate.

10. The squeegee assembly defined in claim 1 wherein said wedge member is formed generally in the shape of a trapezoid.

11. The squeegee assembly defined in claim 1 wherein first and second squeegee blades are positioned between said first and second plates, said wedge bar is positioned between said squeegee blades, and movement of said wedge bar in said second direction causes said first and second surfaces of said wedge bar to move toward said first and second squeegee blades, thereby securing said squeegee blades to the squeegee assembly.

12. The squeegee assembly defined in claim 1 wherein said angled surface of said wedge bar is a downwardly facing surface, and said angled surface of said wedge member is an upwardly facing surface.

13. The squeegee assembly defined in claim 1 wherein said first and second plates are vertically oriented, and a horizontally extending top plate is positioned between said first and second plates to provide a housing which defines an enclosed space which faces downwardly.

14. The squeegee assembly defined in claim 13 wherein said wedge member is releasably secured to said top plate by a fastener extending therebetween, and said fastener extends through a vertically extending slot formed in said end of said wedge bar.

15. The squeegee assembly defined in claim 1 wherein said ends of said first and second plates converge to form a wedge, and said first and second converging surfaces of said wedge bar taper to a point which is similar in shape to said wedge.

16. The squeegee assembly defined in claim 1 wherein said first direction is generally upward and said second direction is generally outward.

17. A squeegee assembly comprising:

first and second plates having ends, said first and second plates positioned so that said ends of said first and second plates generally converge;

a squeegee blade positioned between said first and second plates;

a wedge bar positioned between said squeegee blade and said second plate, said wedge bar having an end with a tapered surface and first and second converging surfaces, converging at approximately the same convergence as said first and second plates; and a wedge member having an angled surface which is positioned adjacent to said tapered surface of said wedge bar, wherein movement of said wedge member in a first direction causes said wedge bar to move in a second direction which is generally normal to said first direction, because of the cooperating tapered surface of said wedge bar and angled surface of said wedge member, the movement of said wedge bar in said second direction causing said first surface of said wedge bar to move toward said squeegee blade, and said second surface of said wedge bar to move toward said second plate, thereby securing said squeegee blade to the squeegee assembly.

18. A floor cleaning machine for hard surfaces comprising:

a movable chassis; and a floor cleaning mechanism carried on said chassis, said floor cleaning mechanism including an applicator for applying liquid to said floor and a vacuum structure for removing liquid from said floor, said vacuum structure including a squeegee assembly comprising:

first and second plates having ends, said first and second plates positioned so that said ends of said first and second plates generally converge;

a squeegee blade positioned between said first and second plates;

a wedge bar positioned between said squeegee blade and said second plate, said wedge bar having an end with an angled surface and first and second converging surfaces; and a wedge member having an angled surface which is positioned adjacent to said angled surface of said wedge bar, wherein movement of said wedge member in a first direction causes said wedge bar to move because of the cooperating angled surfaces of said wedge bar and said wedge member in a second direction, the movement of said wedge bar in said second direction causing said first surface of said wedge bar to move toward said squeegee blade, and said second surface of said wedge bar to move toward said second plate, thereby securing said squeegee blade to the squeegee assembly.

19. The floor cleaning machine defined in claim 18 wherein said second direction is generally normal to said first direction.

20. The floor cleaning machine defined in claim 18 wherein said first and second converging surfaces of said wedge bar converge at approximately the same convergence as said first and second plates.

* * * * *